United States Patent [19]

Forster et al.

[11] 4,367,792

[45] Jan. 11, 1983

[54] SURFACE CONDENSER

[75] Inventors: Leslie L. Forster, Easton, Pa.; Edward F. Hay, deceased, late of Belvidere, N.J., by Constance Hay, executrix

[73] Assignee: Ecolaire, Incorporated, Malvern, Pa.

[21] Appl. No.: 179,410

[22] Filed: Aug. 18, 1980

[51] Int. Cl.[3] ..... F28B 9/08

[52] U.S. Cl. ..... 165/113

[58] Field of Search ..... 165/113, 114

[56] References Cited

U.S. PATENT DOCUMENTS

| | | | |
|---|---|---|---|
| 1,777,280 | 10/1930 | Bancel et al. | 165/113 |
| 2,830,797 | 4/1958 | Garland | 165/113 |
| 2,939,685 | 6/1960 | Worn et al. | 165/114 |
| 4,016,927 | 4/1977 | Palmer | 165/111 X |

*Primary Examiner*—William R. Cline
*Assistant Examiner*—Theophil W. Streule, Jr.
*Attorney, Agent, or Firm*—Seidel, Gonda, Goldhammer & Panitch

[57] ABSTRACT

A steam surface condenser has its tube bundle arranged in a manner so as to have an outer zone of tubes for receiving cold water and surrounding an inner zone of tubes containing warmer water so that most of the condensing of the steam is in the outer zone. A gas cooling section is located in the outer zone adjacent the upper end of the tube bundle. Condensate trays are provided adjacent the cooling section at spaced points along the length of the tube bundle for receiving condensate. Conduits are provided for conveying the condensate from the trays to the exterior of the shell so that such condensate does not contaminate condensate in a hot well.

10 Claims, 4 Drawing Figures

SURFACE CONDENSER

BACKGROUND OF THE INVENTION

Steam condensers having two or more passes with one pass being cold water and the other pass being warmer water are known. For example, see U.S. Pat. No. 1,777,280 where the water in tubes 0 is colder than the water in tubes L which in turn is colder than the water in tubes K. The provision of condensate removal trays per se are known. For example, see U.S. Pat. No. 4,016,927.

The surface condenser of the present invention is directed to a solution of the problem of how to construct a tube bundle so that it is more compact, can be vented more efficiently and also is a solution to the problem of providing more efficient operation with steam originating from a source such as geothermal wells which present a contamination problem. The contamination problem with geothermal wells is how to remove components of the steam which are objectionable from a contamination point of view such as hydrogen sulfide gases, and also to prevent the main body of the condensate from contact with such contamination.

SUMMARY OF THE INVENTION

The present invention is directed to a steam condenser which includes a tube bundle mounted within a shell. The shell has a steam inlet and a steam outlet. The tube bundle has an inner zone of tubes surrounded by an outer zone of tubes. Means is provided for introducing cold water through the outer zone tubes and warmer water through the inner zone tubes. The bundle is spaced from the shell interior surface so that steam flow is radially inwardly toward the inner zone and upwardly therefrom into a cooling section located in the outer zone adjacent the top of the bundle. The cooling section includes a duct extending longitudinally of the tube bundle along the length thereof and having multiple inlets for receiving non-condensable gases and associated steam. Condensate trays are provided at spaced locations along the length of the tube bundle adjacent the cooling section. Conduits are provided for conveying condensate from the trays to the exterior of the shell so that such condensate does not contaminate condensate in the hot well.

It is an object of the present invention to provide a novel steam condenser which is more compact while being capable of handling regular steam or contaminated steam such as steam from a geothermal well.

It is another object of the present invention to provide a steam condenser wherein most of the steam is condensed in an outer cold zone which contains a gas cooling section whereby the average pressure drop through the tube bundle is reduced but is substantially uniform through each compartment along the length of the condenser.

It is another object of the present invention to provide a steam condenser which is adapted for use with geothermal wells and designed for removal of condensate containing non-condensable contaminating gases such as hydrogen sulfide.

Other objects will appear hereinafter.

For the purpose of illustrating the invention, there is shown in the drawings a form which is presently preferred; it being understood, however, that this invention is not limited to the precise arrangements and instrumentalities shown.

DETAILED DESCRIPITION

Figure 1:
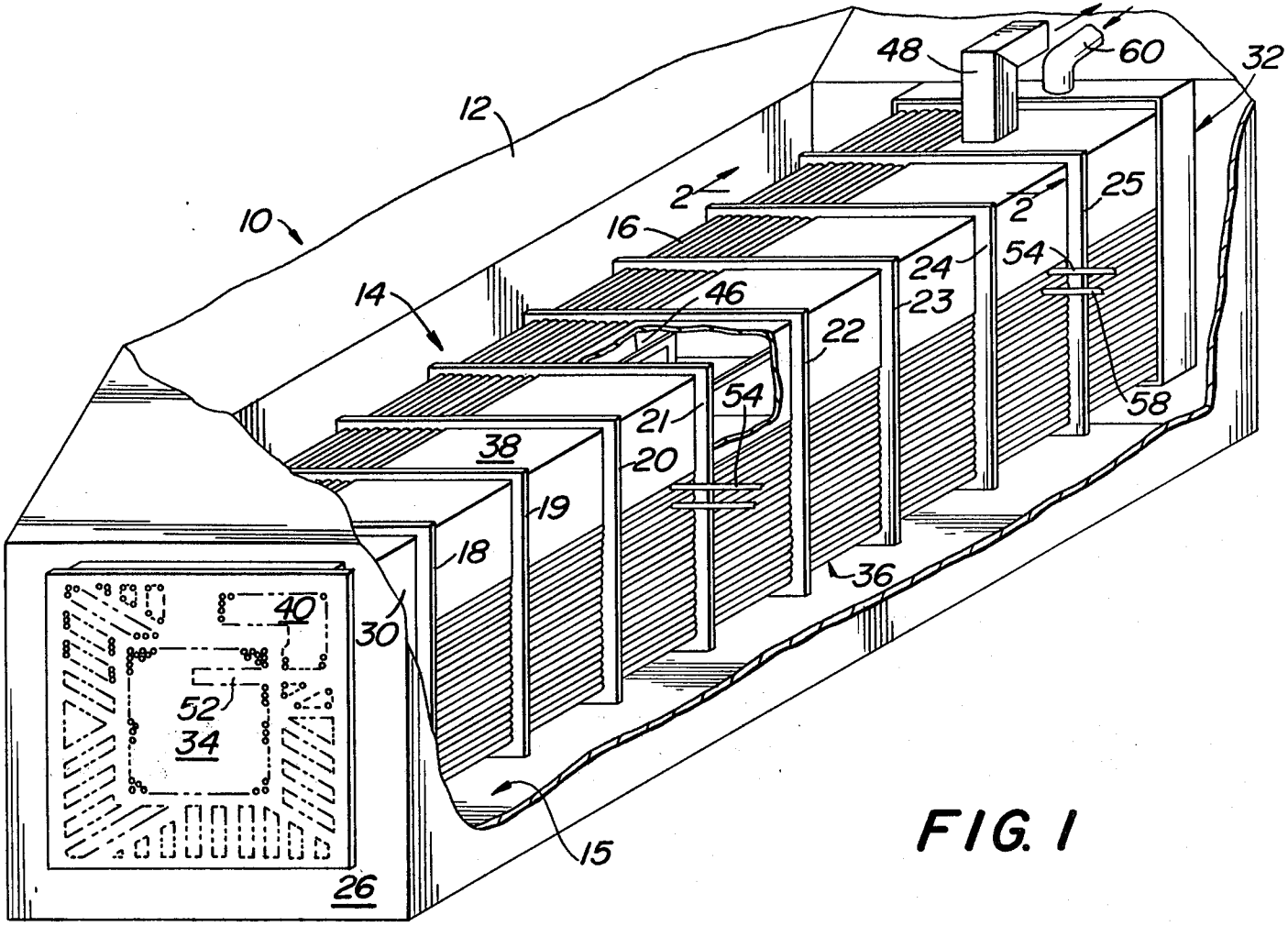
FIG. 1 is a perspective view of the condenser partially broken away.

Referring to the drawings in detail, wherein like numerals indicate like elements, there is shown a condenser in accordance with the present invention designated generally as 10. For purposes of illustration the condenser is a surface condenser having only a single tube bundle within a housing designated generally as 12. If desired the housing 12 could have two or more tube bundles parallel to each other. Housing 12 is illustrated as being of the domed type having an inlet at its upper end for receiving steam and other gases from a source of pressurized steam such as the discharge from a turbine, a geothermal well, etc. The housing 12 as illustrated contains a single tube bundle 14 supported by bracket means not shown above a hot well 15 which is disposed in the bottom of the housing 12. Hot well 15 is provided with a valved outlet conduit.

The tube bundle 14 includes a plurality of horizontally disposed tubes 16 supported at spaced points therealong by identical support plates 18–25. The tubes 16 are also supported at their ends by tube sheets 26 and 28. Tube sheet 26 cooperates with a water box 30. Tube sheet 28 cooperates with a water box 32. The water boxes will be described in greater detail hereinfater.

Figure 2:
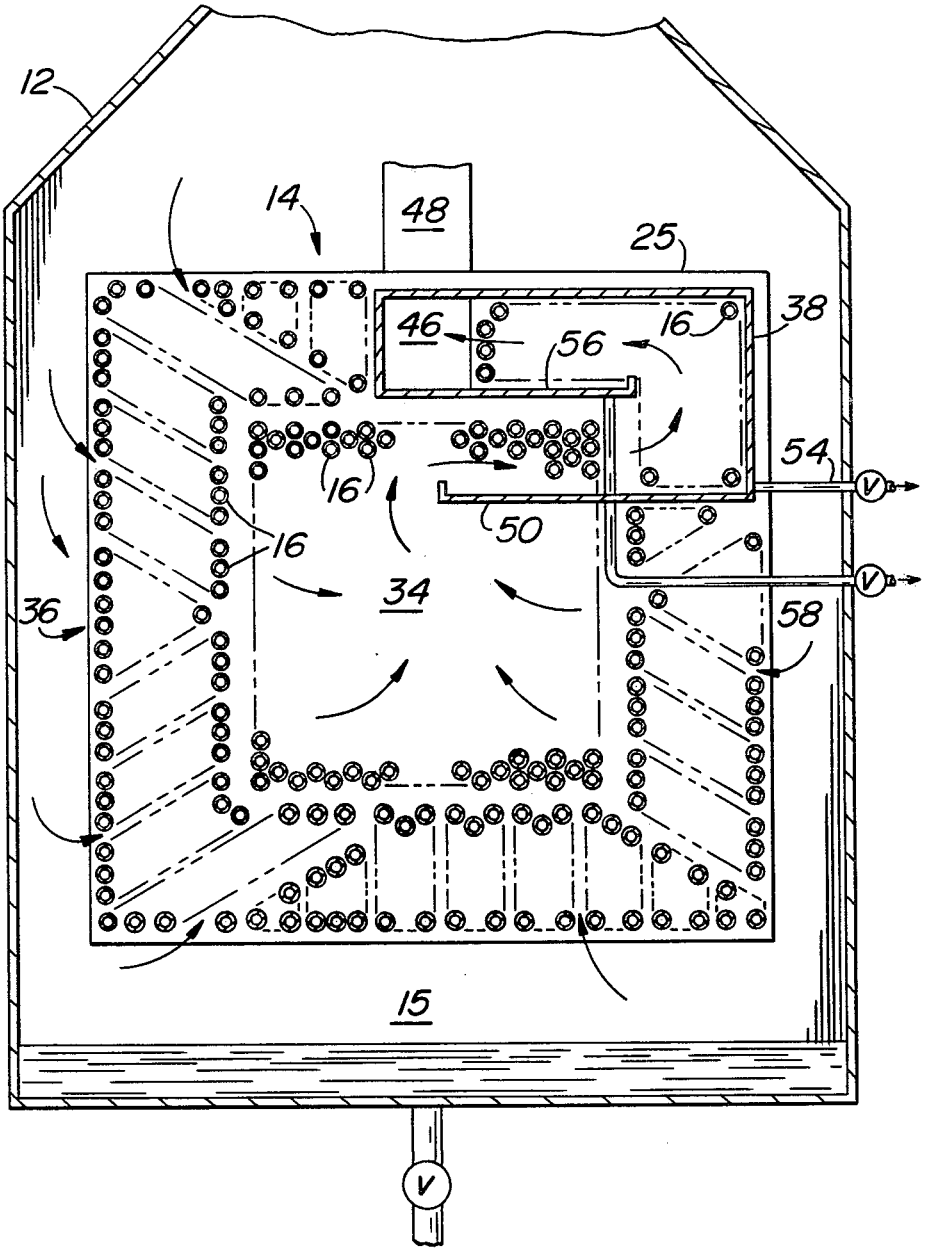
FIG. 2 is a sectional view taken along the line 2—2 in FIG. 1.

Referring to FIG. 2, an important aspect of the present invention is the fact that the tubes 16 are arranged into two discreet zones namely an inner zone 34 and an outer zone 36. As will be made clear hereinafter, water flowing through the tubes 16 in the outer zone 36 is cooler than the water flowing through the tubes 16 in the inner zone 34. The tubes 16 in the outer zone 36 are arranged to define lanes through which the steam must pass in a radially inwardly direction to reach the tubes of the inner zone 34. The design conditions may be such that these lanes are not necessary and the outer zone 36 tubes can therefore be arranged in close spacing as the tubes in the inner zone 34.

Referring to FIGS. 1 and 2, it will be noted that within the outer zone 36, some of the tubes 16 are disposed within a cooling section housing 38 which is generally L-shaped. Each of the tubes sheets 26 and 28 have holes for accommodating the tubes 16 of the outer zone 36. Each of the tube sheets 26 and 28 have holes accommodating the tubes 16 of the inner zone 34. Each of the tube support plates 18–25 is constructed in the same manner as the tube sheets 26 and 28 as pertains to tube holes. The housing 38 along its entire length communicates at spaced locations between adjacent support plates with a longitudinally extending gas vapor duct 46. At one end of the duct 46, there is provided a discharge conduit 48.

A discrete tray 50 is provided adjacent the upper end of the inner zone 34 where it communicates with the cooling section housing 38 between each of the support plates 18–25. A tray 50 is similarly provided between tube sheet 26 and the adjacent support plate 18 as well as between the tube sheet 28 and its adjacent support plate 25. Each of the tube sheets and support plates is provided with an untubed area designated 52 in FIG. 1. The untubed areas 52 and the housing 38 cooperate to support and provide room for the trays 50. Condensate collected in tray 50 is removed directly from the tube bundle to a location externally of the housing 12 by way of a valved conduit 54. While only two conduits 54 are illustrated in FIG. 1, it will appreciated that such a conduit can be associated with each of the trays 50 between each of the support plates 18–25 and the adjacent tube sheets at opposite ends of the housing 12. Illustration of each conduit 54 would unnecessarily complicate the illustration in FIG. 1.

A tray 56 is provided above each of the trays 50. Tray 56 is preferably integral at one end with the housing 38 and forms a bottom wall of the horizontal leg of the housing 38. Tray 56 is disposed within the outer zone 36 and preferably also constitutes a bottom wall for the duct 46. Condensate colected by tray 56 is discharged externally in the housing 12 by way of a valved conduit 58. Each valved conduit 58 is not illustrated in FIG. 1 since it would unnecessarily complicate the illustration.

Figure 3:
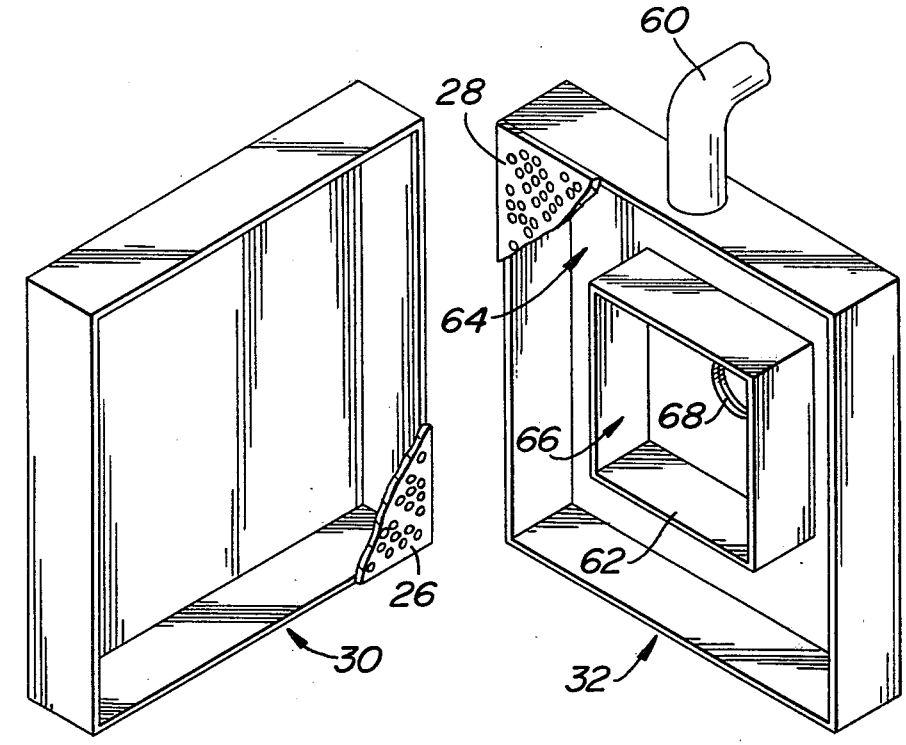
FIG. 3 is a perspective view of the water boxes which are located at the ends of the tube bundle.
Figure 4:
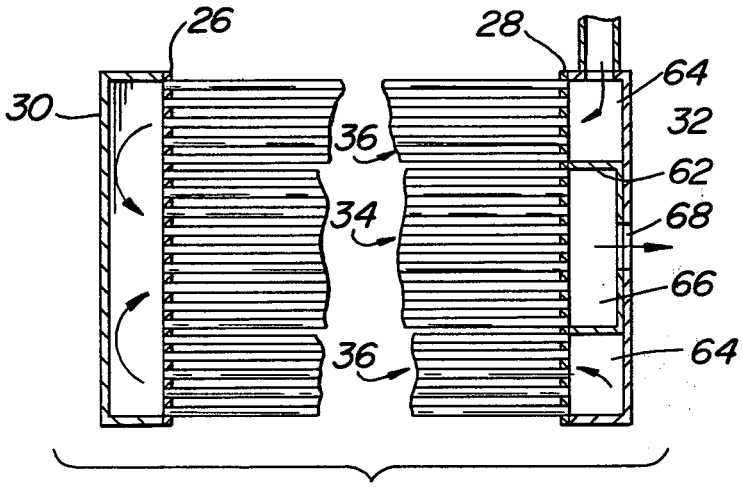
FIG. 4 is a diagrammatic vertical sectional view of the tube bundle.

One of the water boxes is simply a rectangular housing in the form of a tray with its open side fixedly secured to a tube sheet. Such a water box is designated 30 and shown in FIGS. 3 and 4. The other water box such as water box 32 is provided with both an inlet and an outlet for the cooling water flowing through the tubes 16.

The water box 32 is in the form of a open top tray with its open side joined or adjacent to the tube sheet 28. Within the water box 32, there is provided a rectangular wall 62 whose periphery corresponds to the periphery of the inner zone 34. As a result thereof, there is provided a rectangular chamber 64 corresponding in size and aligned with the outer zone 36 and a second inner chamber 66 aligned with and corresponding in size to the inner zone 34. Cooling water is introduced into the chamber 64 by way of an inlet conduit 60, flows through tubes 16 of outer zone 36, enters water box 30, and returns through tubes 16 of inner zone 34 to chamber 66. Cooling water exits from the chamber 66 by way of an outlet 68. The conduit which outlet 68 communicates with is not shown.

DESCRIPITION OF OPERATION

Steam and any gases associated therewith are introduced downwardly into the housing 12 so as to surround the tube bundle 14. The steam flows radially inwardly through the outer zone 36. Water flowing through the tubes 16 in the outer zone 36 is cooler than that flowing through the tubes of the inner zone 34. Before the water flows through the tubes of the inner zone 34, it will have already passed through the entire length of the outer zone 36.

Since the water in the tubes of the outer zone 36 is colder than the water in the tubes of the inner zone 34, most of the steam is condensed by the tubes 16 in the outer zone 36. Steam flows inwardly through the outer zone 36 toward the inner zone 34 and then upwardly thereform into the cooling section defined by housing 38 which is adjacent the top of the bundle 14. The cooling section includes a chamber which extends longitudinally of the tube bundle 14 and has a duct 46. Duct 46 has multiple inlets at spaced locations along the length of the tube bundle as defined by the space between adjacent support plates 18–25 so that vapors may enter the duct 46 along its entire length.

Since most of the steam is condensed in the outer zone 36, the average pressure drop through the tube bundle 14 is reduced but is substantially uniform in each compartment defined by the space between adjacent support plates 18–25 along the length of the condenser 10.

The gas-vapor cooling section is in the outer zone 36 and therefore minimum steam will be in the gases in contact with the tubes 16 within the housing 38. The trays 50, 56 provide for collecting and draining off condensate which will be concentrated as to any noncondensable gaseous impurities in the steam. If the steam is from a geothermal well, there will be a high concentration of hydrogen sulfide gases in the condensate collected by the trays 50, 56. It is desirable that any such concentration of hydrogen sulfide or other immpurities not be permitted to mix with the water in the hot well 15 which will be used in a conventional manner. A substantial concentration of a gas such as hydrogen sulfide in the hot well water would defeat the object of a good geothermal steam condenser. The condensate collected from these trays are removed from the condenser, and can be separately rejected and/or treated to remove the hydrogen sulfide.

The cold water pass in outer zone 36 occurs at the periphery of the tube bundle 14 where any contaminating gas concentration in the steam is at a minimum. Most of the steam is condensed in the cold water pass defined by the outer zone 36 because of the greater temperature difference between steam and water. This major portion of the condensed steam will be the least contaminated by any contaminating gases such as hydrogen sulfide because of the low gas concentration and will drop directly into the hot well 15 before it has a chance to become contaminated.

Venting of the noncondensable gases by the duct 46 along the entire length of the tube bundle 14 provides for certain advatages. Thus, along the entire length of the tube bundle 14 there is a minimum concentration of noncondensable gases. The structural interrelationship of the present invention does not depend on cascading of gases and associated vapor along the length of the tube bundle prior to venting of the same. Therefore, there is no need for openings in the support plates 18–25 to accommodate such cascading of gases. As a result thereof, the tube bundle 14 is more compact. Falling condensate from the tubes 16 is generally opposite the direction of steam flow as indicated by the arrows in FIG. 2. Hence, maximum gas stripping of condensate will occur with the hottest steam which also has the minimum concentration of any gaseous components which are undesirable such as hydrogen sulfide.

since the steam flow is generally upwards as far as it is possible to do so, and since the gas cooling sections are located at the top of the tube bundles, the maximum gas concentration is in contact with the least condensate flow or concentration. This further results in minimum contamination of hydrogen sulfide in the main body of the condensate.

The present invention may be embodied in other specific forms without departing from the spirit or essential attributes thereof and, accordingly, reference should be made to the appended claims, rather than to the foregoing specification, as indicating the scope of the invention.

It is claimed:

1. A steam condenser comprising a tube bundle mounted within a shell which is horizontally disposed, said shell having a steam inlet and a condensate outlet from a hot well, the improvement comprising at least one tube bundle within the shell and having an inner zone of tubes surrounded by an outer zone of tubes, means for introducing cold water through the outer zone of tubes and warmer water through the inner zone tubes so that most of the steam is condensed by the outer zone tubes with steam flow being radially inwardly toward the inner zone tubes and upwardly therefrom into a cooling section, the cooling section being in the outer zone and extending along the length of the tube bundle at the upper end thereof, said cooling section including a conduit having multiple inlets at spaced locations therealong for receiving cooled non-condensable gases and associated steam.

2. A condenser in accordance with claim 1, including condensate trays at spaced along locations along the length of the tube bundle adjacent the cooling section, and conduits for conveying condensate from the trays to the exterior of the shell, whereby condensate from the trays is prevented from mixing with condensate in the hot well beneath the tube bundle.

3. A condenser in accordance with claim 2, wherein said trays are located only at the upper end portion of the inner zone and between said zones at the upper end of the tube bundle.

4. A condenser in accordance with claim 1 wherein said outer zone tubes are at least in the lower part of the outer zone arranged in lanes extending generally inwardly toward the inner zone.

5. A condenser in accordance with claim 1, wherein the tubes of the outer zone communicate with the tubes of the inner zone at a water box at one end of the tube bundle.

6. A method of condensing steam containing contaminating gases comprising the steps of introducing the steam generally upwardly through an outer zone of horizontal tubes containing cold water toward an inner zone of horizontal tubes containing warmer water so that most of the steam is condensed by the tubes in the outer zone, introducing the steam and non-condensable gases upwardly from the inner zone to a cooling section extending along the length of the tube bundle and located in the outer zone, removing non-condensable gases and associated steam at spaced locations along the length of the cooling section and conveying the same from the shell, collecting condensate and any dissolved contaminating gas at spaced locations along the length of the cooling section and thereafter conveying the same to the exterior of the shell whereby condensate containing contaminating gases is prevented from mixing with any condensate in a hot well beneath the tube bundle.

7. A method in accordance with claim 6, including directing steam through the outer zone in lanes directed generally radially inwardly toward the inner zone.

8. A method in accordance with claim 6, wherein the water flows first through the tubes of the outer zone and then flows in an opposite direction through the tubes of the inner zone.

9. A condenser in accordance with claim 1 including spaced support plates for said tubes, each of said inlets to said conduit communicating with the space between a pair of adjacent support plates.

10. A method in accordance with claim 6 including arranging said spaced locations to correspond to the space between adjacent support plates for tubes of said tube bundle.

* * * * *